United States Patent [19]

Wartian

[11] 4,432,576

[45] Feb. 21, 1984

[54] DOOR LATCH

[75] Inventor: George Wartian, East Detroit, Mich.

[73] Assignee: Wartian Lock Co., St. Claire Shores, Mich.

[21] Appl. No.: 306,288

[22] Filed: Sep. 28, 1981

[51] Int. Cl.[3] ..... E05C 21/00

[52] U.S. Cl. ..... 292/357; 292/244; 292/DIG. 53; 292/DIG. 60; 292/DIG. 64

[58] Field of Search ..... 292/357, 337, 244, 1, 292/DIG. 53, DIG. 60, DIG. 64

[56] References Cited

U.S. PATENT DOCUMENTS 3,107,113 10/1963 Sconzo ..... 292/357 X

*Primary Examiner*—Richard E. Moore

*Attorney, Agent, or Firm*—Barnes, Kisselle, Raisch, Choate, Whittemore & Hulbert

[57] ABSTRACT

A door latch for storm and screen doors having pre-drilled bolt receiving openings therein by which the latch housing are secured to opposite sides of the door. One of the latch housings has a plurality of openings therein and the other housing has a pair of inserts each having an inwardly extending internally threaded mounting post adjacent one end thereof and projecting through one of the openings in the door for receiving a threaded bolt inserted through an aligned opening in the other housing. The inserts are reversible end-for-end to vary the spacing between the mounting posts thereby to adapt the latch for use on doors having differently spaced bolt openings therein.

4 Claims, 8 Drawing Figures

DOOR LATCH

BACKGROUND AND SUMMARY OF THE INVENTION

Door latches for storm and screen doors are normally mounted on the door by means of a pair of bolts which extend through the casing or housing on one side of the door and through pre-drilled openings in the door into threaded engagement within internally threaded bosses or mounting posts on the housing on the other side of the door. Door latches currently used by door manufacturers may have bolt receiving openings for a spacing of either 1½", 1¾" or 3". When it is desired to replace a worn and defective latch it is not always possible to obtain a new latch of the same make as the one being replaced, or in which the spacing of the bolt holes in the latch is the same as the spacing of the existing holes in the door, thus making it necessary to drill additional holes in the door. The present invention provides a latch which is adapted to be used on doors having differently spaced bolt openings therein without the necessity of drilling any holes in either the door or the latch housing.

In general the invention comprises a door latch having a pair of latch housings adapted to be mounted on opposite sides of the door, one of the housings having a plurality of openings therein and the other housing having a pair of inserts each having a generally oblong portion seated in a correspondingly shaped recess in the outer wall of said other housing and an inwardly extending mounting post adjacent one end thereof and projecting through the door for receiving a threaded bolt inserted through an aligned openings in said one housing to secure the latch to the door, inserts being slidable and reversible end-for-end within their respective recesses to vary the spacing between the mounting posts thereby to adapt the latch for use on doors having differently spaced bolt openings therein.

DETAILED DESCRIPTION

Figure 7:
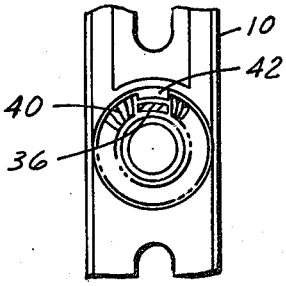
FIG. 7 is a sectional view taken on line 7—7 on FIG. 4.

The latch mechanism includes a latch housing 10 mounted on the outer side of the vertical stile 12 of a storm or screen door and a housing 14 mounted on the inner side of the stile 12. The latch mechanism is operated from the outside of the door by a knob 16 and from the inside of the door by a handle 18. The handle 18 has a tapered nose portion 20 which is engageable with a spring biased strike pin 22 in a conventional manner to hold the door in its closed position. The knob 16 has a stem 24 provided with a square opening 26 which receives one end of a square rode 28 so that the rod 28 is rotatable with knob 16. The outer latch housing 10 has a central collar 30 which rotatably receives a cylindrical extension 32 of the stem 24 to rotatably mount the knob 16 in the housing 10. A washer 34 is non-rotatably mounted on the inner end of the inner portion 32 of the stem 24 and has an outwardly projecting lug 36 extending into a recess 38 in the collar 30 as shown in FIG. 7. A coil spring 40 is disposed within the recess 38 and has its ends abutting the lug 36 on the washer 34 and a fixed stop 42 provided on the collar 30 within the recess 38. The spring 40 will be compressed upon rotation of the knob 16 in either direction and thus will return the knob to its normal position shown in FIG. 7 when the knob is released.

The handle 18 on the inner side of the door is provided with a tubular portion 44 which at its inner end has a cylindrical stem 46 having a square opening 48 which receives the inner end 50 of the square rod 28 so that rotation of knob 16 will effect rotation of handle 18 to disengage the nose 20 of the handle from the strike pin 22. The cylindrical portion of handle 18 is seated against a collar 52 on the inside latch housing 14. A latch member 54 in the form of a washer is seated on a reduced diameter portion of the stem 46 and the inner end of such stem is turned over against the inner face of the latch member 54 to secure the handle 18 and the latch member 54 to the housing 14.

Figure 2:
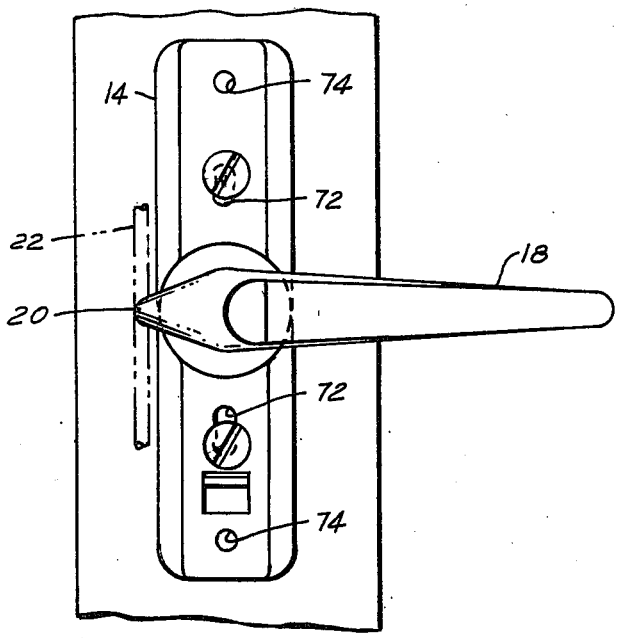
FIG. 2 is a front elevational view of the latch housing which is mounted on the inside of the door.
Figure 1:
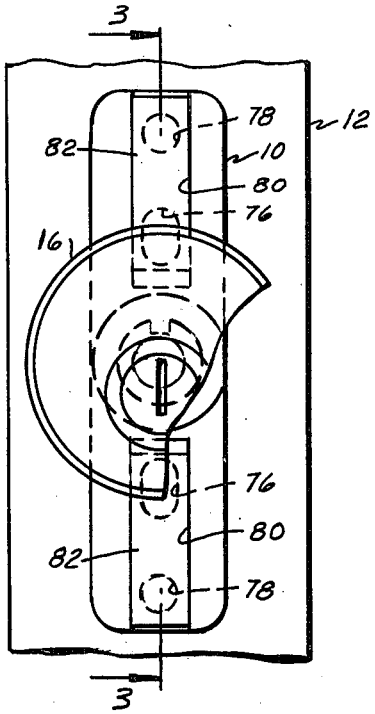
FIG. 1 is a front elevational view of the latch housing which is mounted on the outer side of the door.
Figure 3:
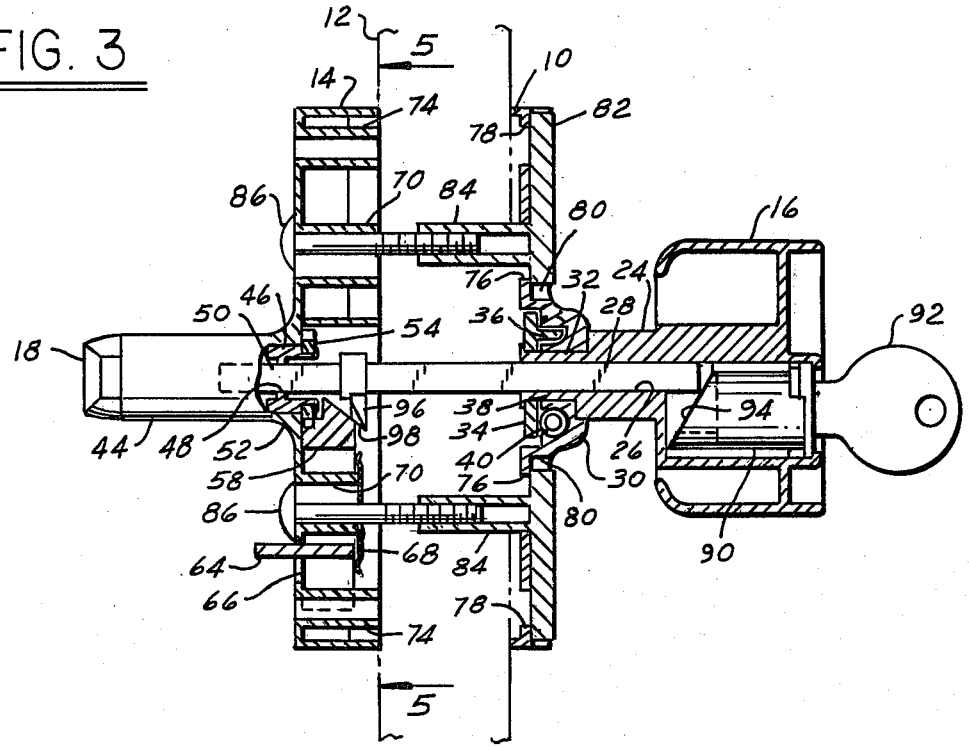
FIG. 3 is a vertical sectional view taken on line 3—3 of FIG. 1 and showing the latch in its locked condition.
Figure 4:
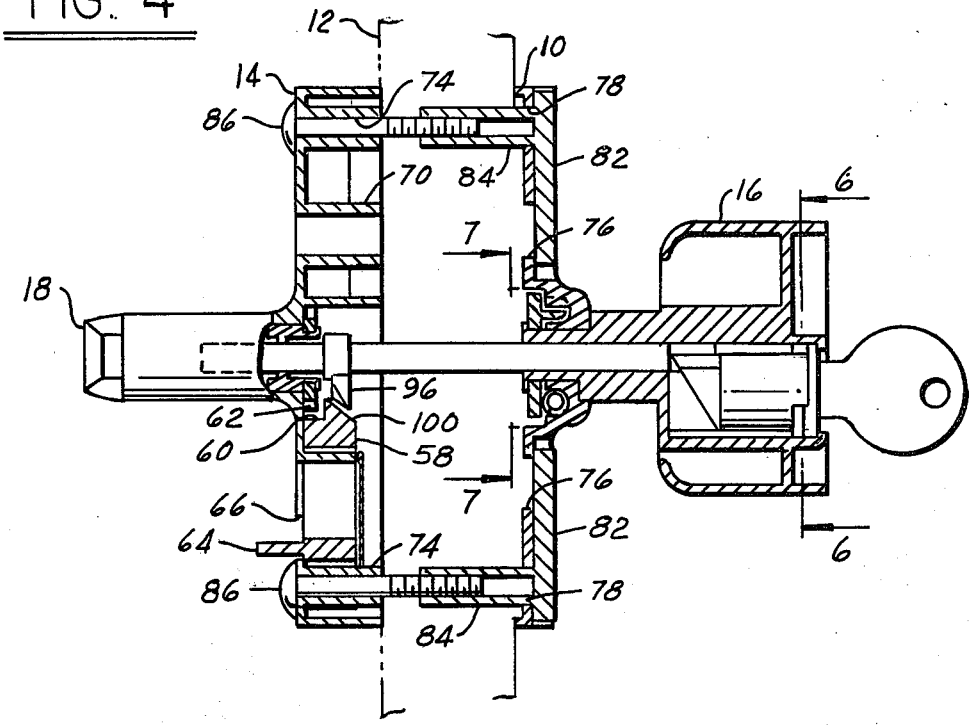
FIG. 4 is a sectional view similar to FIG. 3 showing the latch in its unlocked condition and illustrating a different spacing of the bolts which secure the latch to the door.
Figure 6:
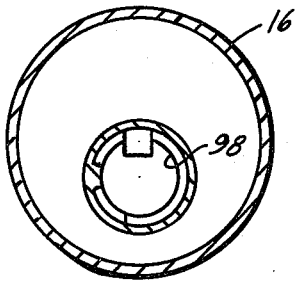
FIG. 6 is a sectional view taken on line 6—6 of FIG. 4.
Figure 5:
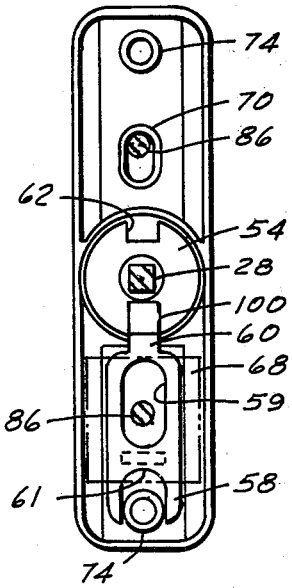
FIG. 5 is an elevational view taken on line 5—5 of FIG. 3.
Figure 8:
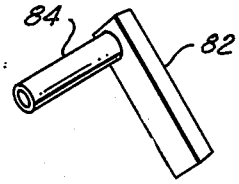
FIG. 8 is a perspective view of one of the inserts used on the outer latch housing.

A latch 58 is mounted within the housing 14 for vertical sliding movement between the latched position shown in FIG. 3 and the unlached position shown in FIG. 4. The latch 58 has an upwardly extending portion 60 which is adapted to be received within a notch 62 on the latch member 54 as shown in FIG. 3 so as to prevent rotation of the stem 46 of the handle 18. The latch 58 is operated from the inside of the door by an inwardly extending operating lug 64 which projects through an opening 66 in the outer wall of the housing 14. A plate 68 overlies and is secured to the inner end of one of a pair of vertically elongated bosses 70 formed on the housing 14 and confines the latch 58 for sliding movement against the outer wall of the latch housing 14. The latch member 58 has an elongated slot 59 to accommodate boss 70 and a plate 68 has a similar opening through which one of the bolts may pass The bosses 70 provide vertically elongated openings 72 in the housing 14, and a pair of circular bosses 74 are provided adjacent the ends of the housing 14. Latch 58 has an end slot 61 to receive one of the bosses 74. The housing 10 is provided with openings 76 opposite the bosses 70 and openings 78 opposite the bosses 74. The housing 10 is provided with vertically elongated recesses 80 at its opposite ends. A pair of inserts 82 are received within the recesses 80 and each insert has adjacent one end thereof a tubular mounting post 84 which is internally threaded to receive a threaded bolt 86 insertable through one of the bosses 70 and 74 and through the existing drilled holes in the door stile 12. The inserts 82 are reversible end-for-end within their respective recesses 80 so that the mounting posts 84 thereof may project through either an opening 78 in the housing 10 to receive a bolt 86 inserted through a boss 74 in housing 14, or through an opening 76 in housing 10 to receive a bolt 86 inserted through a boss 70 in housing 14. With this construction it is thus possible to adapt the door latch for use on doors having pre-drilled holes of a number of different spacings. For example, FIG. 3 shows use of the inserts to accommodate door openings having spacing of $1\frac{3}{4}''$, while FIG. 4 shows the inserts reversed to accommodate a spacing of 3". The recesses 80 in housing 10 are longer than the inserts 82 so that the inserts may be slid inwardly from the position shown in FIG. 3 to provide a spacing of $1\frac{1}{2}''$ between the mounting posts 84. The elongated openings 72 in housing 14 permit bolts 86 to be threaded into posts 84 through doors having holes $1\frac{1}{2}''$ apart.

If desired, the outer door knob 16 may be provided with a key operated lock 90 so that when the latch is locked from the inside of the door by sliding the latch member 58 upwardly to the position shown in FIG. 3, the door may be unlocked by manipulation of the key 92. The lock element 90 is eccentrically disposed relative to the operating rod 28 and when the key is manipulated to rotate the lock element 90 the beveled surface 94 thereof will engage the outer end of rod 28 to shift the same inwardly to the position shown in FIG. 4. A projection 90 on the rod 28 has beveled end 98 engageable with a corresponding beveled surface 100 on the upper end of latch member 58 so that as the rod 28 is shifted inwardly by lock member 90, the latch member 58 will be shifted downwardly to the position in FIG. 4 in which it disengages from the notch 62 in latch element 54, thus enabling the knob 16 to be rotated and thus rod 28 to rotate the handle 8 to disengage the strike pin 22. When the rod 28 is in position shown in FIG. 4 the latch member 58 may be slid upwardly to lock the door and such movement of latch 58 will shift the rod 28 outwardly to the position shown in FIG. 3.

I claim:

1. A door latch for storm and screen doors having a pair of pre-drilled bolt receiving openings therein by means of which the latch is secured to the door; comprising a pair of latch housings adapted to be mounted on opposite sides of the door, an operating handle carried by each housing and latch mechanism cooperatively associated with and operable by said handles, one of said housings having a plurality of openings therein, the other of said housings, having a pair of inserts each having an outer portion seated in a correspondingly shaped recess in said other housing and an inwardly extending internally threaded mounting post, said mounting posts being insertable through said openings in said door for receiving bolts insertable through aligned openings in said one housing, each insert being reversible end-for-end within its recess and having its mounting post located nearer to one end thereof than the other so that end-for-end reversal of said inserts will vary the spacing between said mounting posts thereby to adapt said latch for use on doors having differently spaced bolt openings therein.

2. A door latch according to claim 1, wherein said inserts are slidable away from each other within said recesses when said mounting posts have their narrowest spacing to provide three possible spacings of said mounting posts.

3. A door latch according to claim 2, wherein two of said plurality of openings in said one housing are elongated so as to be aligned with said mounting posts in either of two possible spacings thereof.

4. A door latch for storm and screen doors having a pair of pre-drilled bolt receiving openings therein by means of which the latch is secured to the door; comprising a pair of latch housings adapted to be mounted on opposite sides of the door, an operating handle carried by each housing and latch mechanism cooperatively associated with and operable by said handles, one of said housings having a plurality of openings therein, the other of said housings having a pair of inserts each having a generally oblong outer portion seated in a correspondingly shaped recess in said other housing and an inwardly extending internally threaded mounting post adjacent one end thereof, said mounting posts being insertable through said openings in said door for receiving bolts insertable through aligned openings in said one housing, said inserts being slidable toward and away from each other within said recesses to provide a spacing of said mounting posts of either $1\frac{1}{2}''$ or $1\frac{3}{4}''$, and being reversible end-for-end within their respective recesses to provide a spacing between said mounting posts of 3" thereby to adapt said latch for use on doors having bolt openings therein having a spacing of any of said dimensions.

* * * * *